US008511081B2

(12) United States Patent
Jemuller

(10) Patent No.: US 8,511,081 B2
(45) Date of Patent: Aug. 20, 2013

(54) HYDRAULIC DAMPING ASSEMBLY AND REGULATING SYSTEM

(75) Inventor: Georg Jemuller, Munich (DE)

(73) Assignee: HAWE Hydraulik SE, Munich (DE)

( * ) Notice: Subject to any disclaimer, the term of this patent is extended or adjusted under 35 U.S.C. 154(b) by 754 days.

(21) Appl. No.: 12/783,204

(22) Filed: May 19, 2010

(65) Prior Publication Data

US 2010/0310386 A1 Dec. 9, 2010

(30) Foreign Application Priority Data

May 28, 2009 (EP) ..... 09007166

(51) Int. Cl.
*F15B 11/042* (2006.01)

(52) U.S. Cl.
USPC ..... 60/452; 92/12.1

(58) Field of Classification Search
USPC ..... 60/445, 452; 92/12.1
See application file for complete search history.

(56) References Cited

U.S. PATENT DOCUMENTS 7,555,899 B2 * 7/2009 Maier et al. ..... 60/452

FOREIGN PATENT DOCUMENTS

| | | | |
|---|---|---|---|
| DE | 3227452 | A1 | 2/1983 |
| EP | 0084835 | A | 8/1983 |
| EP | 1577563 | A | 9/2005 |
| GB | 1095347 | | 12/1967 |
| JP | 50132501 | | 10/1975 |

OTHER PUBLICATIONS

European Search Report for EP 09007166.3 dated Oct. 6, 2009.

* cited by examiner

*Primary Examiner* — Thomas E Lazo
(74) *Attorney, Agent, or Firm* — Cook Alex Ltd.

(57) ABSTRACT

For both adjustable flow restrictors D1, D2 having variable cross-sections a common adjustment element 21 is provided mechanically coupling the restrictors in a hydraulic damping assembly D for regulating parameters of a regulating system S, in particular of a variable displacement pump P, the restrictors D1, D2 being provided in discharge paths 12, 13 such that the restrictor cross-sections can be varied within an adjustment stroke h. The common adjustment element 21 allows to simultaneously and oppositely vary the flow restriction cross-sections A of both flow restrictors having a variable cross-section. The restrictor cross-sections A of both flow restrictors D1, D2 having a variable cross-section of a hydraulic damping assembly S in a regulating system S of a variable displacement pump P can be varied simultaneously and oppositely according to an imminent specification of the system set by the manufacturer.

12 Claims, 3 Drawing Sheets

HYDRAULIC DAMPING ASSEMBLY AND REGULATING SYSTEM

The invention relates to a hydraulic damping assembly according to the preamble of claim 1 and to a regulating system according to the preamble of claim 12.

BACKGROUND OF THE INVENTION

It is known in high pressure hydraulic systems to provide a hydraulic damping assembly damping pressure oscillations. The damping assembly is equipped with flow restrictors in two flow paths. The flow restrictors may be two flow restrictors having fixed cross-sections, or one flow restrictor having a fixed cross-section and a flow restrictor having a variable cross-section, or even two flow restrictors having variable cross-sections. Such damping assemblies e.g. are known for load holding valves of hydraulic consumers or are applied in regulating systems of variable displacement pumps. In the latter case the hydraulic damping assembly influences the dynamic performance of the variable displacement pump, e.g. in order to minimise or eliminate overshooting.

In a regulating system of a variable displacement pump as known in practice a flow restrictor having a variable cross-section is arranged in a discharge flow path extending from an actuating piston of the variable displacement pump to the low pressure side and a further flow restrictor having a variable cross-section is arranged in a discharge path extending from a 3/2-multi-way slider valve to the low pressure side, respectively. The 3/2-multi-way slider valve regulates, e.g. in dependence from load pressure, the actuation of the pump actuating piston via the supply pressure and a pressure relief of the actuating piston to the lower pressure side. The damping effect is executed with the help of internal leakage flows across the flow restrictors having variable cross-sections. Each of the flow restrictors having a variable cross-section contains an adjustment element in order to allow to set the cross-section of the restrictor upon demand. An optimum absorption of pressure oscillations within the regulating system of the variable displacement pump e.g. needs to consider the imminent requirements of the system in the connection with internal leakage at the discharge side of the actuating piston and internal leakage at the discharge side of the 3/2-multi-way slider valve, i.e., to increase the respective other cross-section of one flow restrictor when the cross-section of the one flow restrictor decreases. In the case that tunings are to be carried out at both adjustment elements of both flow restrictors, it is complicated to carry out relatively accurate adjustments according to imminent system specifications in the regulating system. Such adjustments need a great deal of knowledge of the system and expertise and are time consuming as then an effect of an adjustment carried out can only be determined during operation of the regulating system. Any adjustments then merely lead to a compromise of the ratio between the final cross-sections of both flow restrictors. This is a consequence of the fact that the producer of the regulating system is aware of the imminent specifications of the system, but has no influence on adjustments carried out later by the user of the regulating system. In addition, two flow restrictors having variable cross-sections and their own adjustment elements require larger structures.

EP 0 084 835 A discloses a regulating system of a variable displacement pump. A 4/3 feedback multi-way valve is provided in order to carry out pilot pressure control of a multi-way valve provided for two actuating cylinders of the variable displacement pump. The feedback multi-way valve is actuated in dependence from the pressure supplied to one of the actuating cylinders. A neutral position can be adjusted in the feedback multi-way valve in which neutral position both pilot pressure sides of the multi-way valve are commonly pressure relieved to the tank via two flow restrictors having fixed cross-sections. When the feedback multi-way valve switches out of the neutral position the flow restrictors having fixed cross-sections become blocked by the valve element of the feedback multi-way valve.

In a control device known from JP 50-132501 A the control device is supplied with pressure medium by a variable displacement pump. A pressure compensator is provided parallel to a multi-way valve. The pressure compensator is either actuated manually by a hand lever or is actuated by pilot pressures. The multi-way valve controls the pressure actuation of a hydro-consumer by the variable displacement pump. In the pressure compensator a piston is co-operating with two lands alternatively orifice-like with exit ports in order to connect a pressure port either with the tank or with a continuing pilot channel.

EP 1 577 563 A discloses a hydraulic control device for a working machine which hydraulic control device is supplied by a variable displacement pump. A main circulation valve is arranged between the variable displacement pump and the tank. The main circulation valve is actuable via a solenoid valve in order to relieve hydraulic medium either directly to the tank or to direct the hydraulic medium to a group of multi-way valves for different consumers. Each multi-way valve of the group contains a through flow channel to the tank which, in the neutral position of the multi-way valve, is directly open to the tank and which then is blocked rapidly when the multi-way valve switches out of the neutral position.

GB 1 095 347 A relates to a fluid pressure servomechanism including a valve in which a rotatable valve element when rotated simultaneously adjusts two flow restrictors having variable cross-sections in opposite directions.

DE 32 37 452 A discloses a control and regulating assembly for a settable hydrostatic unit. The unit contains a hydrostatic motor as a drive source of a pressure line in order to produce nearly constant pressure. The hydrostatic motor drives via an output shaft an auxiliary control pump serving as a speed signal emitter. A pilot pressure line of the fixed displacement auxiliary control pump is connected to the tank via a flow restrictor having a variable cross-section. An exit line of the hydromotor which drives the auxiliary control pump is connected to the tank via a multi-way regulating valve and a further flow restrictor having a variable cross-section in order to actuate a setting cylinder of the hydromotor. Both flow restrictors having a variable cross-section may be interconnected so that they can be adjusted inversely to each other. However, the flow restrictors having variable cross-section do not absorb pressure oscillations but are used for setting the target speed of the hydromotor in both directions of rotation.

SUMMARY OF THE INVENTION

It is an object of the invention to provide a hydraulic damping assembly as well as a regulating system allowing to adjust a respective optimal damping in a structurally simple fashion, rapidly and without a great deal of knowledge of the system.

This object is achieved by the features of claim 1 and the features of claim 12.

Provided that a specification dictated by the system is given between both regulating parameters of the regulating system, which regulating parameters are to be varied by means of the two flow restrictors having variable cross-sections, which specification has to be considered whenever adjustments are carried out, the respective ratio or relationship between the cross-sections of the flow restrictors is predetermined already by the construction and by the mechanical coupling of both flow restrictors having variable cross-sections in the damping assembly, i.e., by the mechanical coupling and the common adjustment element. The respective ratio between the cross-sections is already set by the manufacturer of the components of the damping assembly. Both flow restrictors having variable cross-sections, the discharge paths and the port to the low pressure side as well as the adjustment element are combined in one housing. Both discharged paths intersect at a discharge path node from which, preferably, a single port leads to the low pressure side. Both flow restrictors having variable cross-sections are arranged at the discharge path node and such that they communicate with each other. Both flow restrictors having variable cross-sections use the same connection to the low pressure side. As one positive side aspect the flow restriction effect of both restrictors having variable cross-sections at the discharge path node may even be superimposed. One discharge path leads to the low pressure side through a straight through bore in the housing. The other discharge path intersects the through bore at the discharge path node with a bore which extends crosswise through the through bore, preferably even perpendicular to the through bore, which bore leads into the through bore. The adjustment element is arranged in the bore or in a prolongation of this bore and is adjustable in the direction of the axis of the bore. An optimum absorption effect can be achieved rapidly, as an increasing variation of a flow restrictor cross-section simultaneously dictates a decreasing variation of the other flow restrictor cross-section, and since the courses of the variations accurately consider the specification as given by the system. Any adjustment can be carried out comfortably and rapidly as it is only necessary to manipulate a single adjustment element, and because any adjustment, at least within a portion of the entire adjustment stroke, decreases one flow restrictor cross-section and increases the other flow restrictor cross-section according to the system dependent specification, or vice versa. The mechanical combination of both flow restrictors having variable cross-sections with a view to an inverse or reciprocal simultaneous variation of the flow restrictor cross-sections results in a significant structural simplification. A user easily finds an optimum adjustment as it is only necessary to vary one flow restrictor cross-section, automatically adjusting the other flow restrictor cross-section to a correct size.

The regulating system is characterised among others by an optimum dynamic performance of the variable displacement pump in case of changes of the pump displacement, which changes e.g. are carried out in dependence from the respective load pressure, and are optimally absorbed. By means of the damping assembly overshooting can be minimised or avoided as well as oscillating reactions during any changes of the displacement pump.

In an expedient embodiment the flow restrictor cross-sections are variable linearly and in opposite directions. In this case the respective positive and negative gradients of the linear variation may be equal or unequal, e.g. respectively adapted to the system depending specification between both internal leakages in the regulating system. This advantage is paired with a rapid adjustability of an optimum absorption, even without the operator having specialised knowledge who only has to manipulate a single adjustment element. Any variations of the flow restrictor cross-sections will be executed strictly as predetermined by the manufacturer of the damping assembly or of the regulating system, respectively.

In an alternative embodiment the flow restrictor cross-sections will be adjusted simultaneously and oppositely, however, along non-linear equal or unequal curves having equal or unequal positive or negative gradients. In this fashion the system depending specification between both regulating parameters even may be considered more accurately than with linear variations.

In an expedient embodiment at least the flow restrictor cross-section of one flow restrictor having a variable cross-section may be kept constant in a section within the adjustment stroke at the beginning and/or at the end of the adjustment stroke and at a minimum level or a maximum level such that the curve of the variation of the flow restrictor cross-section forms at least one plateau. In the region of this plateau a certain internal leakage will be maintained even if in some cases the flow restrictor cross-section of the other flow restrictor having a variable cross-section will be further increased or will be decreased at the same time. A plateau may be predetermined for one or both flow restrictors having a variable cross-section by design, and either only at the beginning or at the end or at the beginning and at the end of the adjustment stroke. Such a plateau even may, if suiting the system depending specification, be predetermined within the adjustment stroke, e.g. in a central portion of the adjustment stroke, and for one or the other or for both flow restrictors having variable cross-section.

The flow restrictor cross-section of the one flow restrictor having a variable cross-section at least is defined by the outer periphery of a head diving from the bore into the through bore and by the inner wall of the through bore, the head being provided at the adjustment element or even being part of the adjustment element. The head acts as a restricting body which is increasingly throttling the through bore or increasingly clearing the through bore depending on the position of the adjustment element within the adjustment stroke.

The flow restrictor cross-section of the other flow restrictor having a variable cross-section is defined partly in an exit channel in the head leading into the through bore and partly by a lateral channel penetrating the head and the inner wall of the through bore. Consequently, at least a mouth of the lateral channel in the head is co-operating orifice-like at least within a portion of the adjustment stroke of the adjustment element with the inner wall of the through bore or with an intersection edge between the bore and the through bore, respectively. The orifice-like co-operation allows to achieve a precise, gradual variation of this flow restrictor cross-section.

In order to achieve a plateau for the other flow restrictor having a variable cross-section when varying the flow restrictor cross-section, a flow restrictor having a fixed cross-section may be arranged in the head between the mouth of the discharge channel and a communication connection with the lateral channel. The fixed cross-section of the flow restrictor having a fixed cross-section is smaller than the cross-section of the lateral channel. This flow restrictor having a fixed cross-section and a variable flow restrictor cross-section or the other flow restrictor having a variable cross-section are acting in parallel. As long as the mouth of the lateral channel is covered by the inner wall of the bore, only the flow restrictor having the fixed cross-section is active such that the flow restrictor having the fixed cross-section maintains a largely continuous flow restrictor cross-section irrespective of a further variation of the flow restrictor cross-section of the flow restrictor having the variable cross-section.

In the case that a plateau is also expedient even for the one flow restrictor having a variable cross-section a throttling cross-section may be formed between the outer periphery of the head and the inner wall of the through bore which throttling cross-section e.g. is smaller than the cross-section of the lateral channel. This throttling cross-section is also maintained open in a maximum final position of the flow restrictor having the variable cross-section. A part of this remaining throttling cross-section may even be the lateral channel of the other flow restrictor having a variable cross-section which lateral channel is then also active for the one flow restrictor having a variable cross-section.

Expediently, the orifice cross-section opened between the lateral channel and the inner wall of the through bore simultaneously constitutes a part of a flow restrictor cross-section of both flow restrictors having variable cross-sections, at least within a partial portion of the adjustment stroke of the adjustment element. In this fashion a complete blockage of one discharge path is avoided, which may be desirable in some cases.

In an expedient embodiment the flow restrictor cross-section of the other flow restrictor having a variable cross-section is defined by the inner wall of a bore provided between the discharge paths leading into the bore and the through bore, and by at least two, preferably three, restrictor locations switched in series and arranged at the head of the adjustment element. Such flow restrictor locations, preferably are constituted by at least one longitudinal groove, preferably by several longitudinal grooves distributed in circumferential direction in the head, and two lands formed at the head and separated by a narrowed region and interrupted by the longitudinal groove, the outer diameters of the lands corresponding at least substantially with the inner diameter of the bore. This embodiment is easy to manufacture because the bores as well as the lands and the narrowed region and the at least one longitudinal groove can be machined with high precision and by using simple tools. This embodiment expediently is used when the damping assembly consists of steel components. The flow restrictor locations switched in series generate a combined throttling effect until the respective frontmost land enters the through bore. Then only the rear flow restrictor location(s) remains active. In this fashion already by the design a predetermined, non-linear course of the variation of the flow restrictor cross-section of the other flow restrictor having a variable cross-section can be achieved. Even and in order to generate a plateau effect the flow restrictor cross-section may be maintained substantially constant despite the adjustment movement of the adjustment element until the frontmost land has moved from the bore into the through bore.

In a structurally simple fashion the adjustment element is an adjustment screw which is threadable in the bore. The adjustment screw has a narrowed region between the head and a threaded section, such that the narrowed section is located in the region of the mouth of the discharge path into the bore. The narrowed section maintains a through flow cross-section in the bore which through flow cross-section may be larger than e.g. the through flow cross-section of the lateral channel and/or of the discharge channel or of the flow restrictor having a fixed cross-section.

In an expedient embodiment the adjustment element is adjusted mechanically, e.g. manually by means of a tool like a wrench or by means of rotatable knob. Alternatively, for this function even an actuator could be used which rotates the adjustment screw. Alternatively, the adjustment element even may be remotely controlled and actuated hydraulically, electrically or electromagnetically or directly linearly within the adjustment stroke. For this function a piston, a proportional solenoid or even a stepped motor could be used.

BRIEF DESCRIPTION OF THE DRAWINGS

Embodiments of the invention will be explained with the help of the drawings. In the drawings:

As one of various possible and not limiting applications of a hydraulic damping assembly D according to the invention FIG. 1 illustrates a regulating system S of a hydraulically variable displacement pump P. The variable displacement pump supplies into a pressure line 1 and via a node 2 e.g. a valve arrangement 3 serving to control at least one not shown hydro-consumer, the load pressure of which is tapped via a pilot line 6. A line 4 branches at node 2 and leads to a 3/2 multi-way slider valve 7 by which via a line 9 an actuating piston 10 is actuable which adjusts the variable displacement pump P (in counterclockwise direction) towards a minimum displacement volume (in clockwise direction) to a maximum displacement volume, assisted by an oppositely operating further spring loaded actuating piston 10'. The 3/2 multi-way slider valve 7 is actuated in a pilot line 5 branching off from the line 4 by a pilot pressure in a direction to a control position in which control position the line 4 is connected with the line 9 and such that the actuating piston 10 is fully actuated. In the opposite pilot direction the 3/2 multi-way slider valve 7 is actuated via the pilot line 6 and a, preferably adjustable, spring 8 in a direction to a control position in which control position the line 9 is connected with a discharge path 13 leading to the low pressure side 17 (e.g. a reservoir R), in order to reduce the pressure actuation of the actuating piston 10. A discharge path 12 as well branches off at a node 11 to the low pressure side 17.

Figure 1:
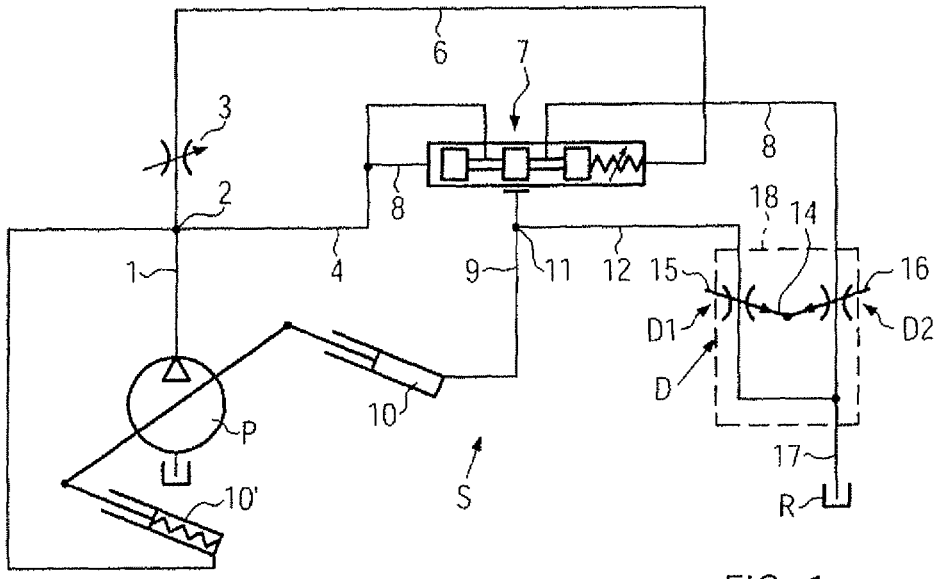
FIG. 1 is a block diagram of a regulating system of a variable displacement pump and a hydraulic damping assembly incorporated into the regulating system.

Both discharge paths 12, 13 lead through the hydraulic damping assembly D to a reservoir R. The hydraulic damping assembly D contains a flow restrictor D1 having a variable cross-section in the discharge path 12 and a flow restrictor D2 as well having a variable cross-section in the discharge path 13. As indicated by arrows 15, 16 the flow restrictor cross-sections of both flow restrictors D1, D2 are variable, and, in particular, by means of a generally indicated common adjustment element 14. Both flow restrictors D1, D2 are mechanically coupled by means of the adjustment element 14, such that (shown by the directions of the arrows 15, 16) one flow restrictor cross-section is decreased while simultaneously the other flow restrictor cross-section is increased, and vice versa, and at least within a partial portion of the entire adjustment stroke of the adjustment element 14. The hydraulic damping assembly D causes internal leakages having the effect of absorbing pressure oscillations within the regulating system S. The absorption effect minimises or eliminates overshooting or an oscillating response performance of changes of the displacement of the variable displacement pump P, respectively.

The internal leakages across both flow restrictors D1, D2 having variable cross-sections are two regulating parameters of the regulating system S for which a given imminent specification of the system is dictated mechanically by the design of the hydraulic damping assembly D.

Figure 2:
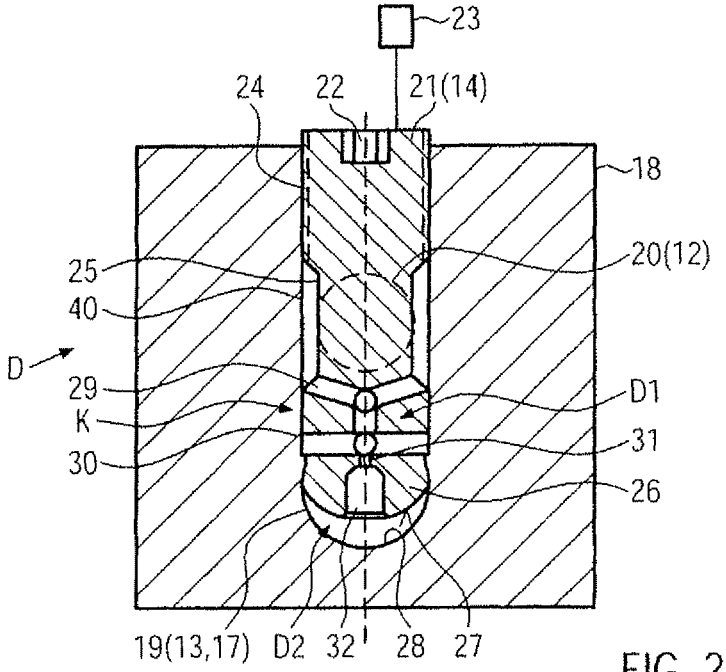
FIG. 2 is a longitudinal sectional view of an embodiment of the damping assembly.

FIG. 2 illustrates in a longitudinal sectional view a more detailed embodiment of the hydraulic damping assembly D which, e.g., can be used in the regulating system S shown in FIG. 1. FIG. 2 contains, at least partly, reference numbers which have already been used in FIG. 1.

Both flow restrictors D1, D2 having variable cross-sections are structurally contained in a housing 18 which is penetrated by a through bore 19. For example, the discharge path 13 from the 3/2 multi-way slider valve 7 of FIG. 1 is connected at the rear end of the through bore 19 the discharge path 13 from the 3/2 multi-way slider valve 7 of FIG. 1, while the front end of the through bore 19 in the figure defines the line 17 or the low pressure side 17, respectively.

Furthermore, a bore 40 is provided in the housing 18 which extends crosswise through the through bore 19, preferably extends perpendicular to the through bore 19. The bore 40 crosses the through bore 19 at a discharge path node K or leads into the through bore 19 at the discharge path node K, respectively. The common adjustment element 14 of both flow restrictors D1, D2 is contained in the bore 40, e.g. in the form of an adjustment screw 21. The adjustment screw 21 is threadably fixed with a thread section 24 in the bore 40 and can be threaded in the direction of the axis of the bore, e.g. by means of an internal wrench hexagon socket 22 or by means of a not shown rotation knob, respectively. Alternatively, even an actuator 23 may be provided such that it engages at the adjustment screw 21, e.g. an electric motor or an step motor, a proportional solenoid, or a hydraulic cylinder, in order to carry out remotely controlled settings at the hydraulic damping assembly D. Instead of the adjustment screw 21 a linearly displaceable actuator could be provided or could actuate a linearly movable adjustment element 14, respectively.

The adjustment screw 21 has a narrowed region 25 continuing the thread section 24. A further bore 20 to which the discharge path 12 is connected leads in the housing 18 to the location of the narrowed section 25. Furthermore, the adjustment screw 21 is formed with a head 26 in continuation of the narrowed section 25. The head 26, e.g. has a spherical or rounded outer periphery 27. The head 26 dives into the through bore 19 in the region of the discharge path node K. The outer periphery 27 of the head 26 and an inner wall 28 of the through bore 19 are defining the flow restrictor cross-section of the one flow restrictor D2 having a variable cross-section. The deeper the adjustment screw 21 is screwed in (FIG. 2) the smaller the flow restrictor cross-section of the flow restrictor D2 will be adjusted.

Branch channels 29 lead from the narrowed region 25 to e.g. two lateral channels 30 in the head 26, which lateral channels 30 cross each other at 90°. At least one mouth of a lateral channel 30 co-acts with the intersection edge at the inner wall 28 of the through bore 19, depending on the screw-in depth of the adjustment screw 21. Optionally, in this case, a substantial axial exit channel 32 extends from the lateral channels 30 to the free front end of the head 26.

In one embodiment (as shown) as an optional feature a flow restrictor 31 having a fixed cross-section is arranged between the lateral channel 30 and the mouth of the exit channel 32 in the front side of the head 26. The fixed cross-section of the flow restrictor 31 having a fixed cross-section is smaller than the cross-section of the lateral channels 30. The axial distance between the lateral channels 30 and the front end of the head 26 is chosen such that the mouth of the lateral channels 30 will be closed by the wall of the bore 40 when the adjustment screw 21 is screwed somewhat further upwardly than shown in FIG. 2, and such that then only a single flow path will remain open extending through the flow restrictor 31 having a fixed cross-section into the through bore. When the adjustment screw 21 is adjusted within a range within which the mouth of the lateral channels 30 are closed, only the cross-section of the one flow restrictor D2 having a variable cross-section is varied, however, the cross-section of the flow restrictor 31 having a fixed cross-section will remain unchanged or will be active alone (plateau effect) as will be explained below. Furthermore, within the adjustment stroke of the adjustment screw 21 the cross-section of the other flow restrictor D1 having a variable cross-section may be varied, e.g. may be increased, by an orifice-like co-action between at least one mouth of the lateral channels 30 and the inner wall 28 of the through bore 28. Then the cross-section of the one flow restrictor D2 having a variable cross-section may be decreased or even may be maintained substantially constant. The cross-section may be maintained substantially constant because an increase or decrease of the cross-section between the outer periphery 27 of the head 26 and the inner wall 28 of the through bore 19 simultaneously causes a decrease or an increase of the orifice cross-section between the lateral channels 30 and the inner wall 28 of the through bore 19. This means that then the one flow restrictor D2 having a variable cross-section also uses the lateral channels 30 which per se are provided for the other flow restrictor D2 having a variable cross-section.

Figure 3:
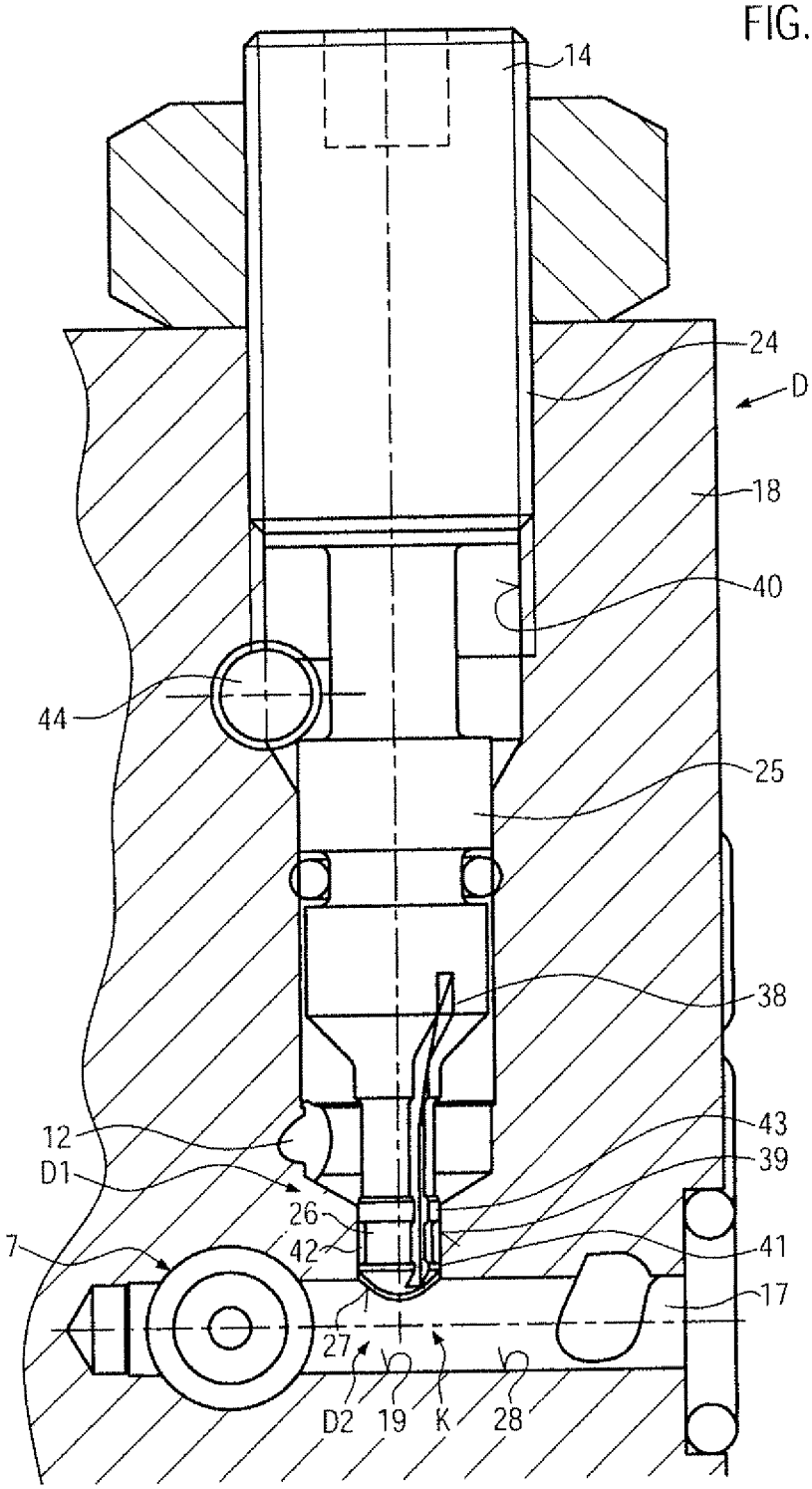
FIG. 3 is a longitudinal sectional view of another embodiment of the damping assembly.

FIG. 3 is a longitudinal sectional view of another embodiment of the damping assembly D. The bore 40 leading to the through bore 19 contains the common adjustment element 14 of both flow restrictors D1, D2 having variable cross-sections. The adjustment element 14 is an adjustment screw which can be secured in placed by a counter nut. The bore 40 is connected by a bore 39 with the through bore 19. The diameter of the bore 39 is smaller than the diameter of the bore 40. The discharge path 12 leads into the bore 40 between a shaft portion 25 of the adjustment element 14 which is sealed in the bore 40 and the bore 39. An inserted screw 44 laterally engaging into the bore 40 forms a stop for the adjustment element 14. The through bore 19 in the block 18, which e.g. is the block of the 3/2 multi-way slider valve 7 of FIG. 1, is a blind bore directly extending from the slider valve bore. The head 26 defines with its rounded outer periphery 27 in co-action with the inner wall 28 of the through bore 19 the one flow restrictor D2 having a variable cross-section in the discharge path 13. The shaft 25 decreases in the direction towards the head 26 and contains at least one longitudinal groove 38. Preferably, there exist several longitudinal grooves 38 e.g. three longitudinal grooves 38, which are distributed in circumferential direction and each has a predetermined depth and width. A narrow land 41 is formed at the head 26 in diving direction of the adjustment element 14 into the through bore 18 at the front side which narrower land 41 is separated by a narrowed region 42 from a rearwardly located wider land 43. Both lands 41, 43 are interrupted by the at least one longitudinal groove 38. The outer diameters of the lands 41, 43 are only slightly smaller than the inner diameter of the bore 39. In this fashion and in the shown embodiment two orifice locations are formed which are switched in series and which act in combination in the position of the adjustment element 14 shown in FIG. 3. Pressure medium intruding from the discharge path 12 first is restricted in the first orifice location of the longitudinal grooves 38 between the land 43 and the inner wall of the bore 39 and then is allowed to expand in the region of the narrowed region 42 because the pressure medium is then throttled in the second orifice location in the longitudinal groove 38 between the land 41 and the inner wall of the bore 39, before the pressure medium enters the through bore 19. This is a position of the adjustment element 14 with a setting for a maximum flow restriction through the one flow restrictor D1 having a variable cross-section. Then the other flow restrictor D2 having a variable cross-section has a setting with a maximum cross-section size.

When the adjustment element 14 is screwed in deeper as shown in FIG. 3, the head 26 and the land 41 enter deeper into the through bore 19. Then only the orifice location in the longitudinal groove 38 between the rear land 43 and the inner wall of the bore 39 remains active, and, in some cases, also an orifice location within the narrowed region 42. As a consequence, the active cross-section of the one flow restrictor D1 having a variable cross-section is increased, while the active cross-section of the other flow restrictor D2 having a variable cross-section is decreased correspondingly.

When the adjustment element 14 is then screwed in even deeper into the bore 40, finally the land 43 enters into the mouth of the bore 39 such that then only the orifice location in the longitudinal groove 38 between the land 43 and the inner wall of the bore 39 remains active. The then acting flow restrictor cross-section will not be varied further in case of a further deeper adjustment of the adjustment element 14, even if then the cross-section of the other flow restrictor D2 having a variable cross-section is decreased further. The sealing of the shaft portion 25 in the bore 40 assures that pressure medium is hindered from exiting from the bore 40 to the exterior.

Figure 4:
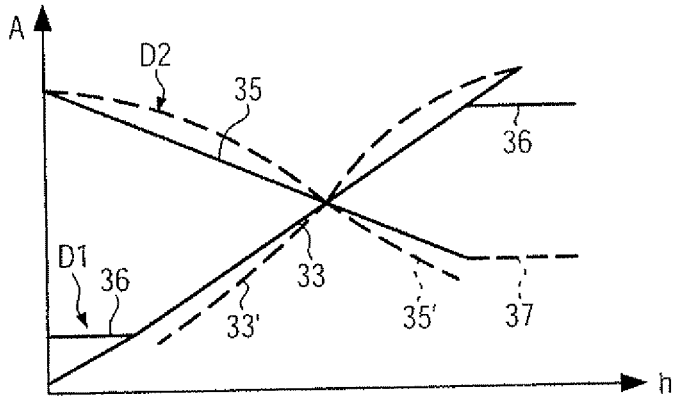
FIG. 4 is an illustration explaining opposite variations of flow restrictor cross-sections of the damping assembly of FIG. 2.

FIG. 4 is a diagram of the course of the variations of the cross-sections A of both flow restrictors D1, D2 having variable cross-sections within the adjustment stroke h of the adjustment element 14. The cross-sections A are varied simultaneously and inversely, i.e., a decrease of the cross-section of the one flow restrictor D2 having a variable cross-section means a corresponding increase of the cross-section of the other flow restrictor D1 as well having a variable cross-section, and vice versa. The variations of the cross-sections of both flow restrictors D1, D2 are shown in FIG. 4 as straight lines 33, 35. The positive and negative gradients of the straight lines 33, 35 may be equal or unequal, respectively. The location of the point of intersection of the straight lines 33, 35 can be predetermined by the design within the adjustment stroke h. Alternatively, the cross-section A of both flow restrictors D1, D2 having variable cross-sections or only the cross-section A of one of the flow restrictors D1 or D2 having variable cross-sections may be varied along curves 33', 35' predetermined by the design, which curves have equal or unequal shapes or have equal or unequal positive and negative gradients (indicated in dotted lines).

As an option or as an alternative, furthermore, FIG. 4 indicates that at least one of the straight lines 33, 35 or of the curves 35', 33' may contain a plateau 36 or 37 in the case shown within a final section. The plateau 36 or 37 means that the respective cross-section A will not be varied any longer even if a further adjustment is carried out. The plateau 37 e.g. is the result of the flow restrictor 31 having a fixed cross-section and shown in FIG. 2, as soon as the lateral channels 30 are blocked. A plateau in the straight line or the curve 30, 33' of the flow restrictor D1 having a variable cross-section e.g. may be generated by a co-action between the decrease of the cross-section between the outer periphery 27 of the head 26 and the inner wall 28 of the through bore 19 and the simultaneous decrease or increase of the orifice opening between at least one mouth of a lateral channel 30 and the inner wall 28 of the through bore 19.

Alternatively or additively (not shown) a plateau even may be predetermined by the design of the damping assembly within an intermediate portion of the adjustment stroke h for the one or the other or for both flow restrictors D1, D2 having a variable cross-section.

Figure 5:
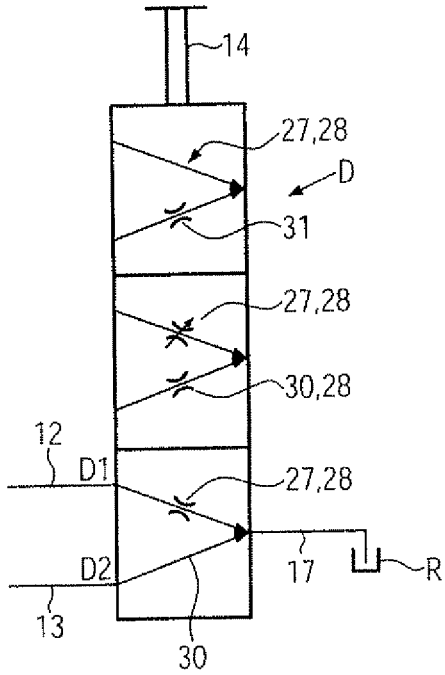
FIG. 5 is a symbolic illustration of the hydraulic damping assembly.

FIG. 5 illustrates a symbolic explanation of the hydraulic damping assembly D. Actually the damping assembly D is a sort of 3/2 multi-way valve situated between the discharge path 12, 13 and the low pressure side 17. This valve is actuated between three positions by the common adjustment element 14 (e.g. the adjustment screw 21).

In the lowest position in FIG. 5 the discharge path 12 of FIG. 2 is connected with a stronger flow restriction effect with the lower pressure side 17 through the cross-section between the outer periphery 26 of the head 26 and the inner wall 28 of the through bore 19 and the orifice opening between at least one mouth of a lateral channel 30 and the inner wall 28 of the through bore 19. The discharge path 13 is connected to the low pressure side 17 through the flow restriction cross-section between the mouth of at least one lateral channel 30 and the inner wall 28 of the through bore 19. The parallelly switched flow restrictor 31 having a fixed cross-section, if provided, does not play any role as long as the orifice opening between at least one mouth of a lateral channel 30 and the inner wall 28 of the through bore 19 is larger than the cross-section of the flow restrictor 31 having the fixed cross-section.

In the middle position the discharge path 12 is connected with reduced flow restriction effect in FIG. 5 to the low pressure side 17 through the cross-section between the outer periphery 27 of the head 26 and the inner wall 28 of the through bore 19. However, the discharge path 13 is only connected with the low pressure side 17 through the open lateral channels 30.

In the uppermost switching position in FIG. 5 the discharge path 12 is connected with even more reduced flow restriction effect with the lower pressure side 17 through the cross-section between the outer periphery 26 of the head 26 and the inner wall 28 of the through bore 19. The discharge path 13 is then only connected with the low pressure side 17 through the flow restrictor 31 having a fixed cross-section (plateau effect).

In the lowermost and the uppermost positions in FIG. 5 respectively defined minimum throttling cross-sections may be predetermined for the discharge path 12 or the discharge path 13, respectively. The middle position represents a control range within which the throttling cross-sections of both flow restrictors D1, D2 having the variable cross-sections are varied oppositely to each other. In the lowermost and uppermost positions the discharge path 13 may act with minimum throttling effect or without significant throttling effect or the discharge path may act with minimum or without any throttling effect, respectively.

In an alternative embodiment the lateral channels 30 could lead to a circumferential extending peripheral groove (not shown) in the outer periphery 27 of the head 26 in order to achieve a precisely defined orifice-like co-action with the inner wall 28 of the through bore 19 or with the intersection edge between the bore 40 and the through bore 19, irrespective of the relative rotary position of the head 26 or of the adjustment screw 21. The effect of this defined co-action then will strictly depend on the screw-in depth of the adjustment screw 21. In a further alternative embodiment the head 26 even may be coupled with the adjustment screw 21 via a rotatable connection. Then, e.g., the head 26 could be guided only linearly displaceably by a pin engaging into an axial guiding groove e.g. of the head 26, such that the head 26 is hindered from rotating with the adjustment screw 21. In this case e.g. a single lateral channel arranged coaxially to the through bore 19 could co-act orifice-like with its mouth with the inner wall 28 of the through bore 19 or the intersection edge between the bore 40 and the through bore 19 only in strict dependence on the screw-in depth of the adjustment screw 21. As a further alternative the flow restrictor 31 having a fixed cross-section could be replaced by a removable screw-in flow restrictor screw which can be replaced against another flow restrictor screw having another fixed flow restrictor cross-section. Finally, the mouth of the lateral channel 30 and/or the outer periphery 27 of the head 26 may be formed with a specific geometric shape in order to vary the respective flow restrictor cross-section according to predetermined criteria when the adjustment screw 21 is rotated, e.g. in order to achieve the courses and/or the plateaus shown in FIG. 4.

The invention claimed is:

1. Hydraulic damping assembly for regulating parameters of a regulating system, in particular for a variable displacement pump regulating system, comprising two flow restrictors in separated discharge paths leading to a low pressure side, the acting cross-section of at least one of the flow restrictors being variable within an adjustment stroke characterised in that both flow restrictors have variable cross-sections, the two discharge paths, the low pressure side and an adjustment element commonly provided for both flow restrictors having variable cross-sections and being adjustable through the adjustment stroke are contained in a housing, that the two discharge paths are interconnected in the housing at a discharge path node, that a single discharge path extends from the discharge path node to the low pressure side, that both flow restrictors having a variable cross-section communicate with each other at the discharge path node, one discharge path being a through bore in the housing and the other discharge path leading with a bore to the discharge path node, which bore crosses the through bore laterally, that the adjustment element which mechanically couples both flow restrictors having variable cross-sections is adjustably arranged in the bore or in a prolongation of the bore such that it is adjustable in the direction of the axis of the bore, and that the adjustment element oppositely and simultaneously varies the cross-sections of both flow restrictors having variable cross-sections at least within a portion of the entire adjustment stroke.

2. Hydraulic damping assembly according to claim 1, characterised in that the cross-sections are oppositely variably linearly, preferably with positive and negative equal or unequal gradients of the variations.

3. Hydraulic damping assembly according to claim 1, characterised in that the cross-sections are oppositely variable along non-linear curves which are equal or are unequal.

4. Hydraulic damping assembly according to claim 1, characterised in that during an adjustment of the adjustment element at least the cross-section of one of the flow restrictors having variable cross-section is maintained substantially constant at a minimum level or a maximum level substantially along a plateau within a start portion and/or an end portion of the adjustment stroke.

5. Hydraulic damping assembly according to claim 1, characterised in that the cross-section of the one flow restrictor having a variable cross-section is defined at least by the outer periphery of a head diving from the bore into the through bore and the inner wall of the through bore, the head being provided at the adjustment element or being a part of the adjustment element, and that the cross-section of the other flow restrictor having a variable cross-section partly is defined in an exit channel leading into the through bore and partly by at least one lateral channel penetrating the head and the inner wall of the through bore, and by at least one mouth of the lateral channel communicating with the exit channel co-operating orifice-like with the inner wall of the through bore.

6. Hydraulic damping assembly according to claim 5, characterised in that a flow restrictor having a fixed cross-section is arranged in the head between the mouth and the exit channel and a communication connection with the lateral channel, the fixed cross-section of the flow restrictor having a cross-section smaller than the cross-section of the lateral channel.

7. Hydraulic damping assembly according to claim 5, characterised in that a throttling cross-section is maintained free between the outer periphery of the head and the inner wall of the through bore, when the head maximally is diving into the through bore, which throttling cross-section, preferably, is smaller than the cross-section of the lateral channel.

8. Hydraulic damping assembly according to claim 5, characterised in that within at least a partial portion of the entire adjustment stroke the open orifice cross-section between the lateral channel and the inner wall of the through bore simultaneously constitutes a part of the cross-sections of both flow restrictors having variable cross-sections.

9. Hydraulic damping assembly according to claim 1, characterised in that the cross-section of the other flow restrictor having a variable cross-section is defined by the inner wall of a bore provided between the discharge path leading into the bore and the through bore and by at least two, preferably, three orifice locations switched in series at the head, preferably orifice locations within at least one longitudinal groove, preferably within several longitudinal grooves distributed in the head in circumferential direction, and by two lands formed at the head and being separated by a narrowed region and being interrupted by the longitudinal groove, the outer diameters of the lands corresponding substantially to the inner diameter of the bore.

10. Hydraulic damping assembly according to claim 1, characterised in that the adjustment element is an adjustment screw which can be screwed in the bore, and that the adjustment screw has a narrowed region between the head and a thread section, the narrowed region being located in the region of the mouth of the discharge path in the bore.

11. Hydraulic damping assembly according to claim 1, characterised in that the adjustment element is actuable mechanically, manually or motorised, by an actuator, or is a remotely actuable hydraulically or electrically or electromagnetically.

12. Regulating system of a variable displacement pump being actuable to change displacement by means of at least one actuating piston, the actuating piston being actuable by actuating pressure taken from the discharge pressure of the variable displacement pump via a pilot pressure controlled 3/2 multi-way slider valve, the regulating system containing a hydraulic damping assembly influencing the dynamic performance of displacement changes of the variable displacement pump, the hydraulic damping assembly containing a respective flow restrictor in a discharge path extending from the actuating piston to a low pressure side and in a discharge path extending from the 3/2 multi-way slider valve to a low pressure side, characterised in that both flow restrictors are flow restrictors having variable cross-sections, the flow restrictors being mechanically coupled by a common linearly adjustable adjustment element which is adjustable through an adjustment stroke, and that the cross-sections of both flow restrictors having the variable cross-sections are variable simultaneously and oppositely to each other within at least a partial portion of the entire adjustment stroke.

* * * * *